US006405700B1

(12) United States Patent
Panzer

(10) Patent No.: US 6,405,700 B1
(45) Date of Patent: Jun. 18, 2002

(54) METHOD FOR HEATING THE COMBUSTION CHAMBERS OF AN INTERNAL COMBUSTION ENGINE

(75) Inventor: Markus Panzer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/627,809

(22) Filed: Jul. 28, 2000

(30) Foreign Application Priority Data

Jul. 30, 1999 (DE) ..... 199 35 898

(51) Int. Cl.[7] ..... F02N 17/00; F02D 9/04
(52) U.S. Cl. ..... 123/179.16; 123/179.21
(58) Field of Search ..... 123/179.21, 179.16, 123/323

(56) References Cited

U.S. PATENT DOCUMENTS 4,096,697 A * 6/1978 Treuil ..... 123/179.21
4,557,233 A * 12/1985 Joppig et al. ..... 123/323
5,657,730 A * 8/1997 Gustavsson ..... 123/179.16

FOREIGN PATENT DOCUMENTS

| | | |
|---|---|---|
| DE | 73 01 889 | 4/1976 |
| DE | 26 25 095 | 12/1977 |
| DE | 33 39 053 | 5/1985 |

* cited by examiner

*Primary Examiner*—Andrew M. Dolinar
*Assistant Examiner*—Arnold Castro
(74) *Attorney, Agent, or Firm*—Kenyon & Kenyon

(57) ABSTRACT

A method for heating the combustion chambers of an internal combustion engine, an exhaust pipe of the fuel-injected internal combustion engine being designed with an exhaust-gas flap; the exhaust-gas flap being closed or retained in the closed state when switching on the ignition of the internal combustion engine and over a predeterminable time of operation of a starter of the internal combustion engine; and no fuel being fed into the combustion chambers during this time.

1 Claim, 1 Drawing Sheet

METHOD FOR HEATING THE COMBUSTION CHAMBERS OF AN INTERNAL COMBUSTION ENGINE

BACKGROUND INFORMATION

Starting a fuel-injected internal combustion engine in a very cold state, such as under arctic conditions, proves to be very difficult in practice. If such a start is carried out without any assistance such as pre-heating the internal combustion engine or a special additive in the fuel, one must expect extremely long start times when temperatures are very low.

For example, German Patent No. 26 25 095 describes opening and closing exhaust-gas flaps in an exhaust pipe of an internal combustion engine manually via an exhaust-brake valve to thus prevent an excessive exhaust-gas pressure in front of the exhaust-gas flaps.

Furthermore, German Patent No. DE-GM 73 01 889 describes a device for controlling exhaust-gas flaps in which the flaps are closed during a cold start of the engine to prevent the formation of white smoke, and are opened again automatically via a time switch after a predetermined time has elapsed. This device is only designed for controlling the exhaust-gas flaps after a cold start of the engine. A similar device is also described in German Patent No. 33 39 053.

The described devices involve a control of the exhaust-gas flaps to suppress white smoke, i.e., the exhaust-gas flaps are actuated in connection with the actual operation of the internal combustion engine.

SUMMARY OF THE INVENTION

An object of the present invention is to provide a method with which combustion chambers of a fuel-injected internal combustion engine can be heated in a simple manner.

According to the present invention, a very simple and inexpensive method is provided for heating the combustion chambers of a fuel-injected internal combustion engine which can replace or supplement previously known measures such as pre-heating the combustion chambers or special fuel additives.

Using the measure of the present invention—retaining the exhaust-gas flap in the closed state during a specific period of time after switching on the ignition of the motor vehicle—prevents a fresh air supply (i.e., the feeding of extremely cold air in arctic conditions), while at the same time the engine is driven via the starter, as a result of which the air present in the combustion chambers (cylinders) of the internal combustion engine is compressed and therefore heated.

It is preferred that the predeterminable time during which the exhaust-gas flap is closed be definable taking into account a state of charge of a battery allocated to the internal combustion engine. This measure allows the method of the present invention to be adapted optimally to a state of charge of a battery so that, for example, when working with a fully charged battery, the start operation can be considerably shortened compared to conventional start operations.

DETAILED DESCRIPTION

Figure 1:
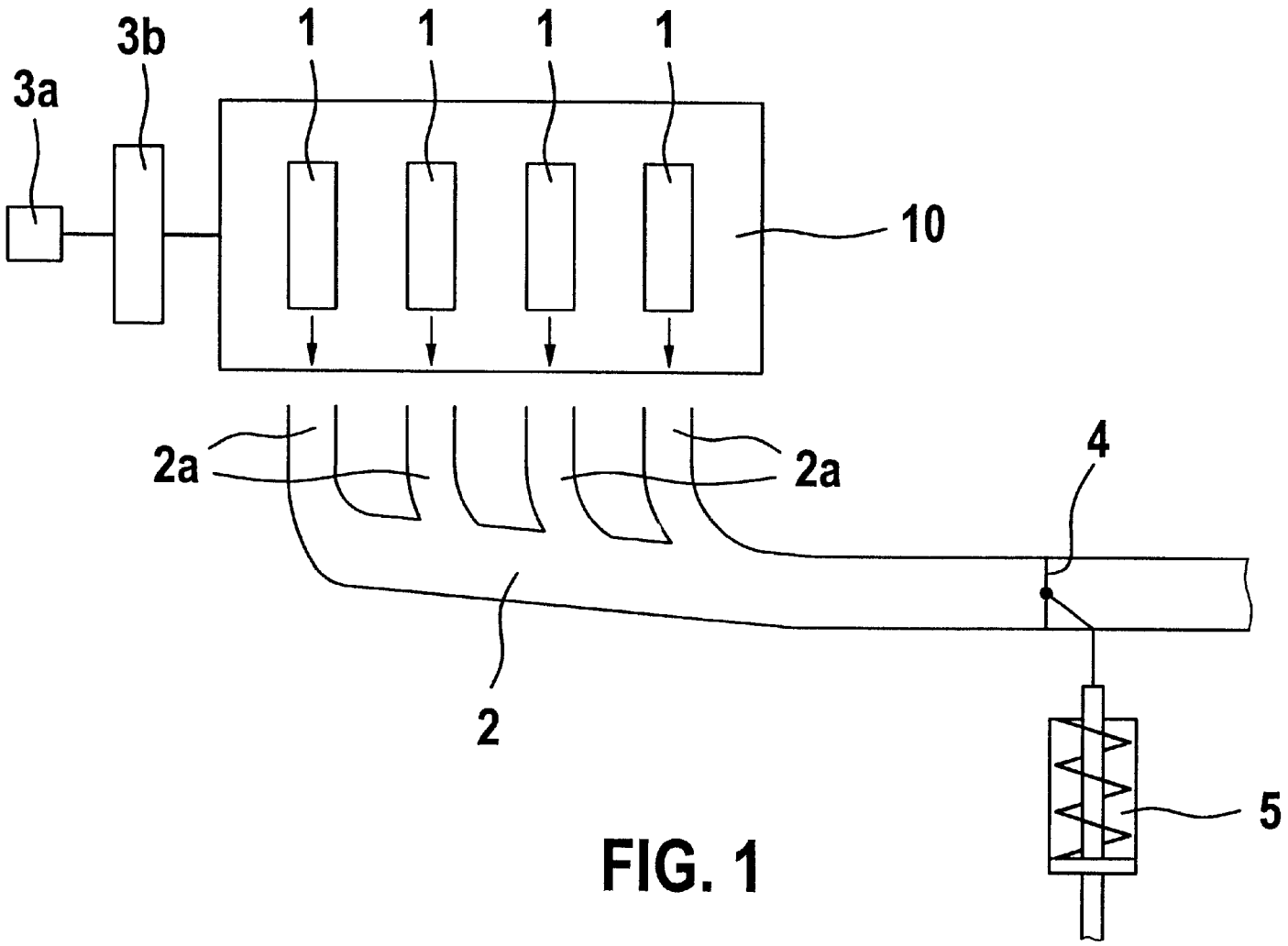
FIG. 1 shows a schematic representation of the components of an internal combustion engine for illustrating the method of the present invention.

In FIG. 1, the individual combustion chambers or cylinders of a four-cylinder engine 10 are represented schematically by reference numeral 1. It is assumed that engine 10 shown is a fuel-injected internal combustion engine, i.e., combustion chambers 1 can be acted upon with fuel with the aid of injection devices (not shown). Each of the exhaust pipes allocated to these combustion chambers 1 discharge via supply lines 2*a* into a main exhaust pipe 2.

The connection between combustion chambers 1 and supply lines 2*a* is shown purely schematically by arrows. A representation of components such as exhaust valves usually used here has been dispensed with for reasons of clarity.

For starting, the internal combustion engine is designed with a starter 3*a*. The internal combustion engine is started in this manner: Starter 3*a*, operated with battery current, sets flywheel 3*b* of the engine into rotation until engine 10 is able to keep running from its own power. As is known and requiring no further explanation, this leads to a compression of the air existing in combustion chambers 1.

The present invention provides that an exhaust-gas flap 4 provided in exhaust-gas pipe 2 be operable by suitable actuating means 5 such as operating cylinders controllable by compressed air.

First of all, to explain the method of the present invention, a standing vehicle having a cold engine is assumed. An ignition lock (not shown) is now moved into the ignition position for the start operation. With this adjustment, exhaust-gas flap 4 is automatically set in the closed state as shown in FIG. 1. Starter 3*a*, which can be acted upon by a battery (not shown), now begins to set flywheel 3*b* of the engine into rotation, in the course of which fuel is not injected into combustion chambers 1 during a time which can be preset. The result is that initially, the air present in combustion chambers 1 is merely compressed. This compression is supported by closed exhaust-gas flap 4 which also assures that an air exchange between the air in combustion chambers 1 or exhaust pipe 2 and the ambient air is avoided. This leads to a heating of the air existing in combustion chambers 1, which means a subsequent start operation of the fuel-injected internal combustion engine can be carried out in a relatively short time.

The period of time during which starter 3*a* is actuated while exhaust-gas flap 4 is closed in order to compress the air in combustion chambers 1 can be set, for example, as a function of an ascertained state of charge of the battery. Of course, in the case of a relatively weak battery, care must be taken to avoid further worsening the battery charge state by actuating the starter too long. The method described permits effective heating of combustion chambers 1 of the fuel-injected internal combustion engine without having to pre-heat the engine.

The method of the present invention is particularly applicable for commercial vehicles which are already traditionally equipped with exhaust-gas flaps to prevent the development of white smoke, for example. The additional outfitting of vehicles such as passenger cars, previously not equipped with exhaust-gas flaps, with an exhaust-gas flap for implementing the method of the present invention proves to be advantageous as well.

What is claimed is:

1. A method for heating combustion chambers of a fuel-injected internal combustion engine, the engine including an exhaust pipe having an exhaust-gas flap, the method comprising the steps of:

when switching-on the ignition of the internal engine and over a predetermined time of operation of a starter of the engine, at least one of (a) closing the exhaust-gas flap and (b) retaining the exhaust-gas flap in a closed state; and feeding no fuel into the combustion chambers during the predetermined time of operation, wherein the predetermined time of operation is a function of a state of a charge of a battery allocated to the engine.

* * * * *